United States Patent [19]

Larman

[11] 3,979,034

[45] Sept. 7, 1976

[54] LOGGER'S COMBINATION FUEL CONTAINER AND TOOL CARRIER

[76] Inventor: Henry J. Larman, Ajlune Rte. Box 102, Mossyrock, Wash. 98564

[22] Filed: Feb. 20, 1975

[21] Appl. No.: 551,306

[52] U.S. Cl. ..... 224/5 W; 224/5 A

[51] Int. Cl.[2] ..... A45F 3/04

[58] Field of Search ..... 224/5 W, 5 R, 5 A, 5 B, 224/25 A; 220/20; 137/578, 588

[56] References Cited

UNITED STATES PATENTS

| | | | |
|---|---|---|---|
| 1,304,114 | 5/1919 | Staples | 224/5 W |
| 3,807,431 | 4/1974 | Svanteson | 137/578 X |

FOREIGN PATENTS OR APPLICATIONS

| | | | |
|---|---|---|---|
| 577,976 | 6/1933 | Germany | 224/5 W |

*Primary Examiner*—Albert J. Makay
*Attorney, Agent, or Firm*—James D. Givnan, Jr.

[57] ABSTRACT

A multiple chamber, fluid container for use by a logger or outdoorsman in the transport of fuel and chain lubricating oil for a motorized chain saw. Each of said chambers is served by a spout arrangement with the fuel spout arrangement including a vent arrangement to facilitate pouring without spillage. Shoulder straps enable transport of the container on the user's back to free his hands for other carrying tasks. Waterproof housings receive files for dressing of the saw cutter teeth with additional means provided on the container permitting secure attachment of an ax and wedge.

3 Claims, 4 Drawing Figures

LOGGER'S COMBINATION FUEL CONTAINER AND TOOL CARRIER

BACKGROUND OF THE INVENTION

The present invention relates generally to portable containers and more specifically to a highly portable container for use by loggers and other outdoorsmen having a powered chain saw. The container includes strap means permitting carrying on the user's back.

In wide use throughout the logging industry for the past several years are chain saws powered by small internal combustion engines which saws have largely replaced hand operated crosscut saws. Such chain saws include a two cycle engine which powers a circulating chain element provided with cutter teeth links which travel about a channeled, elongate saw bar. Various accessory equipment is required by present day chain saws such accessory equipment including a fuel container, an oil container, files for sharpening teeth edges and tools for field maintenance of the saw. Accordingly, a logger entering the woods for a day's work must not only carry the chain saw weighing several pounds but also pack the above accessory equipment with him to the remote logging site. Normally each logger must also be equipped with an ax and wedge for use in tree falling. It will be obvious that the logger who must carry the accessory equipment, chain saw and fuel therefor all separately is severely handicapped particularly when traversing hilly terrain to and from the logging site. Further, it is not uncommon for loosely carried accessory equipment to be lost resulting in repeated costly replacement.

An additional drawback to known fuel containers is the problem encountered in pouring fuel into a small filler opening of a chain saw gas tank with a certain amount of risk encountered when fuel is inadvertently spilled onto hot engine components.

SUMMARY OF THE INVENTION

The present invention is embodied within the container structure for carrying on the back of the user said container structure particularly adapted for use by a logger using a power driven chain saw.

The container is separated into chambers to provide for the storage and transport of the different fluids such as a fuel-oil mixture and a lightweight, chain lubricating oil. Within that portion of the container used for the storage of the fuel-oil mixture a vent arrangement is provided for admission of replacement air into the container during pouring to enable pouring to be accomplished with a steady or uniform rate as opposed to the erratic flow when no vent provisions are made. The container further is provided with strap mounting means to enable portage of the container on the user's back and leaving both hands free for carrying of the chain saw and other gear. Appendages on the container receive different types of tools for the purpose of chain saw maintenance. The container is additionally provided with bracket means within which is received an ax head for convenient transport of an ax while similarly, the container mounts a wedge holder within which a falling wedge is firmly seated.

Important objectives of the present invention include the provision of: a dual purpose fluid container for use by loggers and outdoorsmen which container is particularly adapted for carrying fuel-oil and oil for the operation of a powered chain saw; a dual purpose container having back straps affixed to the container to enable transport of the container on the user's back; a dual purpose fluid container especially for use by loggers and adapted to carry, without risk of loss, various types of accessories or tools including tools for the maintenance of a power chain saw; a dual purpose fluid container for waterproof storage of chain saw files; a dual purpose fluid container providing a vent arrangement for the fuel-oil compartment which enables fuel to flow in a nonturbulent manner into the saw fuel tank; a dual purpose fluid container having flexible spouts which may be sealed by caps which are tethered to the spout to prevent loss in the woods with the caps preventing spillage of the fuel should the container be tipped over. Additional objectives will become apparent upon an understanding of the structure and function of the invention as hereinafter provided.

DESCRIPTION OF THE PREFERRED EMBODIMENT

Figure 1:
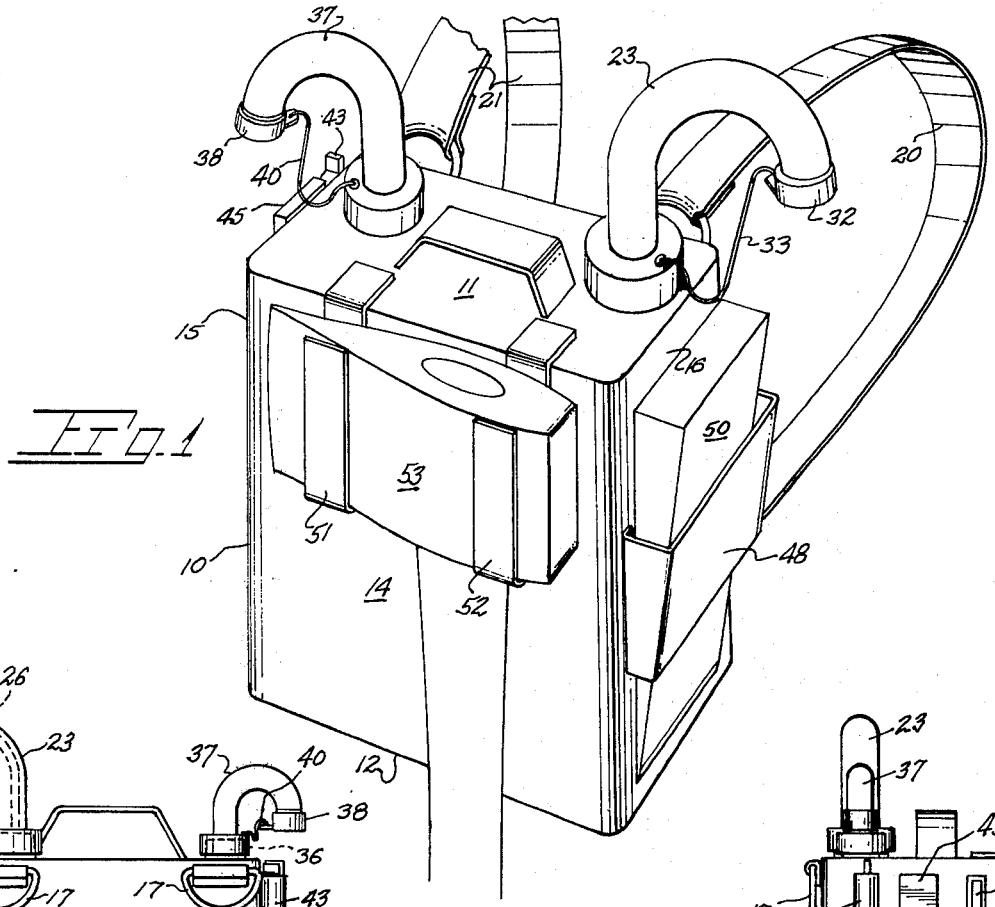
FIG. 1 is a perspective view of the present container.

With continuing reference to the accompanying drawing wherein applied reference numerals indicate parts similarly identified in the following specification, the reference numeral 10 indicates a metal container having top and bottom walls 11 and 12, front and rear walls 13 and 14 and sidewalls 15 and 16. The container may be similar in construction to known metal gasoline containers being of soldered seam construction.

Figure 2:
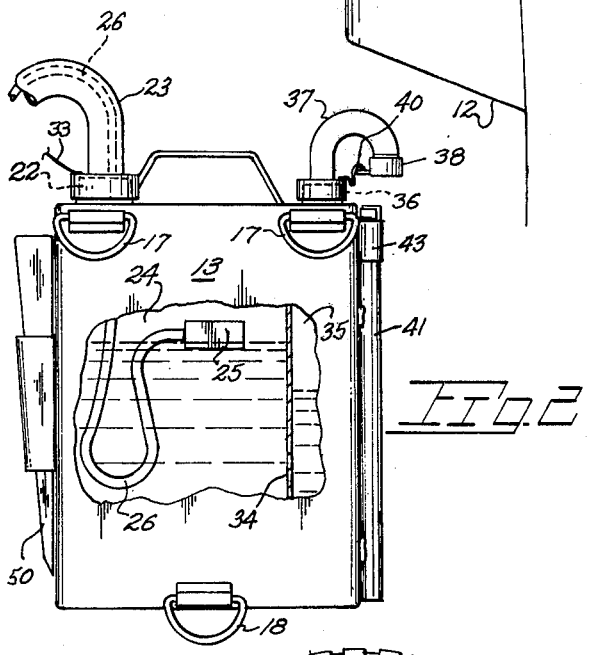
FIG. 2 is a front elevational view of the container with the back straps removed.

With particular attention to FIG. 2, a front wall 13 is provided with a pair of upper eyelets 17 and a lower eyelet 18 which serve to mount a pair of shoulder straps at 20 and 21 shown in FIG. 1. The shoulder straps 20, 21 fit over each of the wearer's shoulders for support of the container on the back importantly leaving the wearer's hands free for other carrying tasks. Top wall 11 of the container is provided with an upstanding threaded collar at 22 which receives a combination cap and spout assembly indicated at 23. Collar 22 defines an opening for a fuel-oil chamber indicated at 24 which also receives a buoyant vent block 25 part of a vent arrangement which also includes a flexible hose 26.

Figure 4:
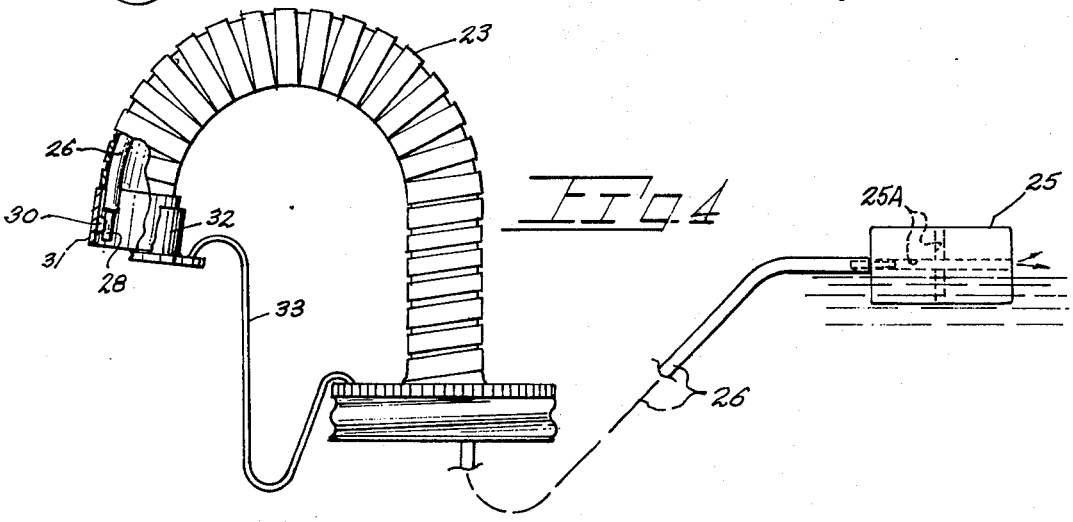
FIG. 4 is an enlarged detailed view of one of the container's spout arrangements separated from the container with a vent assembly shown schematically.

With attention to vent block 25 the same is provided with multiple passageways 25A which serve to permit atmospheric air to be released into chamber 24 as the air space therewithin increases during pouring of the fuel-oil mixture. Vent line 26 may be of neoprene tubing extending upwardly through the flexible metal spout terminating in attachment with a tube segment 28 (FIG. 4) soldered at 30 to the internal wall of a spout end 31. The foregoing vent arrangement permits fuel to flow at a uniform, non-turbulent manner to reduce the chances of fuel spillage which constitutes a fire hazard when the chain saw engine is hot. A friction tight cap at 32 seals spout member 31 against loss of fuel in the event the container is tipped on its side. To assure retention of cap 32 in attachment to spout 31 a tether at 33 is provided intermediate the cap and spout structure.

With attention again to container 10 a partition 34 within same partially defines an oil receiving chamber 35 for the storage of lubricating oil of the type used for periodic lubing of the saw chain and saw bar. Conventionally, such saws include a second tank from which oil is intermittently released by various types of valve mechanisms onto the circulating saw chain. Top wall 11 of the tank is fitted with a second threaded collar at 36 for the reception of a flexible spout arrangement 37 which includes a cap 38 to prevent inadvertent spillage of oil should the container be tipped. Cap 38 is also tethered as at 40 to prevent cap loss.

Figure 3:
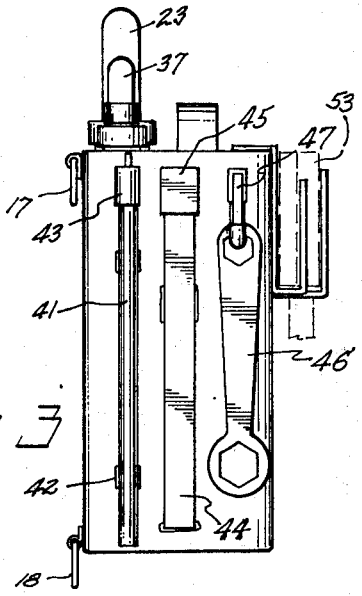
FIG. 3 is a side elevational view taken from the right hand side of FIG. 2.

With attention to FIG. 3, chain saw maintenance tools are mounted on sidewall 15 in a secure manner with a tubular, waterproof housing 41 suitably attached thereto as by soldering at 42 which housing receives a rat tail file for cutter tooth maintenance. A friction tight cap at 43 assures file retention and isolation from the weather. Similarly, a housing 44 receives a flat file used for tooth maintenance with file loss being prevented by a cap 45. A tool such as the wrench at 46 is suspended from a snap 47 also carried by container sidewall 15.

The remaining sidewall 16 serves to mount a bracket 48 which is of U-shape to receive a wedge 50 of the type used by loggers in a tree falling operation while a pair of metal brackets at 51, 52 are of a formable nature to permit their being configured to confine the head 53 of an ax. Said brackets are secured as by soldering to container top wall 11.

Use of the present container is believed obvious from the foregoing description.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A combination fluid container and tool carrier transportable on the back of a chain saw operator, the invention comprising, a fluid container partitioned to define at least two fluid storage chambers, said container having front and rear walls with intermediate side walls, flexible spout arrangements serving each of said chambers, said spout arrangements including a cap closure to prevent spillage, a vent line terminating adjacent the spout end and oppositely in communication with a buoyant vent block within one of said chambers thereby communicating atmospheric pressure to the last mentioned chamber interior, shoulder straps attached to the container permitting convenient transport of same on the operator's back, and tool receiving housings secured in place on at least one wall of said container serving to receive chain saw maintenance tools, said housings of a weatherproof nature to protect tools housed therein.

2. The invention claimed in claim 1 additionally including brackets located adjacent a wall of the container for the reception of an ax head.

3. The invention claimed in claim 2 wherein said brackets are of a bendable nature for shaping to a specific ax head configuration.

* * * * *